United States Patent [19]

Crabiel

[11] 4,006,936

[45] Feb. 8, 1977

[54] ROTARY CUTTER FOR A ROAD PLANER

[75] Inventor: Wesley Irving Crabiel, Galion, Ohio

[73] Assignee: Dresser Industries, Inc., Dallas, Tex.

[22] Filed: Nov. 6, 1975

[21] Appl. No.: 629,341

[52] U.S. Cl. ..... 299/39; 299/89; 299/92

[51] Int. Cl.[2] ..... E21C 47/00; E21C 35/18

[58] Field of Search ..... 299/39, 89, 92

[56] References Cited

UNITED STATES PATENTS

| | | | |
|---|---|---|---|
| 1,670,502 | 5/1928 | Gray | 299/39 |
| 2,916,275 | 12/1959 | Bruestle et al. | 299/92 |
| 3,101,932 | 8/1963 | Wright | 299/39 |

*Primary Examiner*—Ernest R. Purser
*Attorney, Agent, or Firm*—John M. Lorenzen

[57] ABSTRACT

The invention is an improved rotary cutter for a road planer, particularly a cold planer. The rotary cutter comprises a thick-walled metal drum fitted with improved cutter bits and bit holders, according to a preselected pattern. The holders are attached on the drum surface, and each has a tapered socket extending through the main body thereof along a line parallel to the tangent of the drum surface. The corresponding cutter bit has a shoulderless, tapered shank which fits in and is seated snugly in the socket of the holder and a cutting tip lying in a plane generally radial of the drum. The cutting action maintains the firm, tight fit of the cutter bits in the holders and reduces the excessive wear experienced in prior cutters. The invention provides a rotary cutter which is less expensive to make, is more effective in cutting modern paving materials, and which has a longer life span.

25 Claims, 12 Drawing Figures

ROTARY CUTTER FOR A ROAD PLANER

The invention relates to road planers for removing worn, damaged, or uneven surfaces from paved roadways, bridges, runways, and the like prior to repaving them. More particularly, the invention relates to an improved rotary cutter for a cold planer.

Machines for cutting or milling the surfaces of roadways and the like were conceived years ago, although the earlier machines were intended to work on gravel or dirt surfaces. Heated planers were later developed and could remove asphaltic roadways by first applying heat to soften the asphalt. However, it wasn't until recent years that commercially practical cold planers capable of removing aggregate filled asphalt, concrete, and like surfaces without first applying heat became available.

A modern road planer typically consists of self-propelled vehicle mounted on wheels, crawlers, or the like, and supporting from its frame a power-driven rotary cutter. Although not necessarily, the cutter is usually suspended under the vehicle within the perimeter of the surface engaging wheels. The cutter is usually suspended in a manner allowing it to be adjusted vertically and angularly to control the depth and inclination of the cut it makes. A road planer of the type described is shown in U.S. Pat. No. 3,560,050.

Since the technology for heavy construction type vehicles is well developed, the commerical suitability of road planers is at present highly dependent on the effectiveness and durability of the cutting unit. Since the cutter is the part most subject to wear, the frequency and cost of its replacement is a major operting concern for the owners and operators of such equipment. Therefore, a suitable cutter must be capable of removing hard materials, such as concrete, as well as the more elastic materials, such as asphalt, and without needing frequent replacement.

Until now, the technology for the cutting heads for cold planers has borrowed heavily from that used in the mining industry, particularly coal mining. To a large extent, the cutter bits and bit holders used to mine a fragmentable material like coal have been adopted to mill or cut asphalt and concrete pavements. However, these tools have not been suitably effective to mill paved surfaces to a controlled depth. Perhaps more importantly, they have demonstrated a tendency for rapid wear, thus requiring replacement of the cutting heads too frequently.

A more detailed discussion of the problems with the prior art cutting bits and holders used on road planers follows below. It is sufficient to say here that one of the most significant is the tendency of the cutter bits to work loose in the holders. Under the cyclic cutting action of the cutter unit, the resulting movement of the bit in the holder causes the holders to wear rapidly.

It is therefore the object of the present invention to provide an improved rotary cutter for road planing equipment which is more economical to manufacture, more effective in cutting modern paving materials, and has a longer working life.

These improvements in a road planer cutting head are accomplished in the present invention in which the cutter includes a heavy, thick-walled cylindrical drum adapted for suspension from a road planer vehicle and for being rotatably driven by a hydraulic motor or the like. The high inertia of the drum at normal rotational speed facilitates the forceful and steady cutting of even hard materials like concrete.

An improved bit and holder combine with the drum to further enhance the cutting ability of the rotary cutter and significantly increase its life. The holder is adapted for easy and accurate mounting on the drum according to a pre-selected pattern. The holder is provided with a multi-sided tapered opening or socket which extends all the way through the holder along an axis generally tangential to the cylindrical drum. The shank of the cutter bit is similarly shaped in cross-section and tapered to fit snugly into the holder. The shank of the bit is longer than the holder and extends a short distance through the far end of the socket. Thus, the bit can be easily removed by a blow administered against its free end. The body of the bit embraces a hardened cutting tip which is spaced radially outward from the axis of the bit shank and which has a cutting face lying in a plane generally radial to the drum axis. With this arrangement, the cutting action enhances and maintains the snug fit between the bit and holder and prevents the excessive wear of the holder that was experienced in the prior art devices.

In addition to the advantages already pointed out, the rotary cutter of this invention is simple to manufacture using well established techniques. Thus, the invention provides a cutter which not only performs better and lasts longer, but which costs less to make initially.

Having thus briefly described the invention, a more detailed descussion follows with reference to the attached drawings which form part of this specification and of which:

Figure 1:
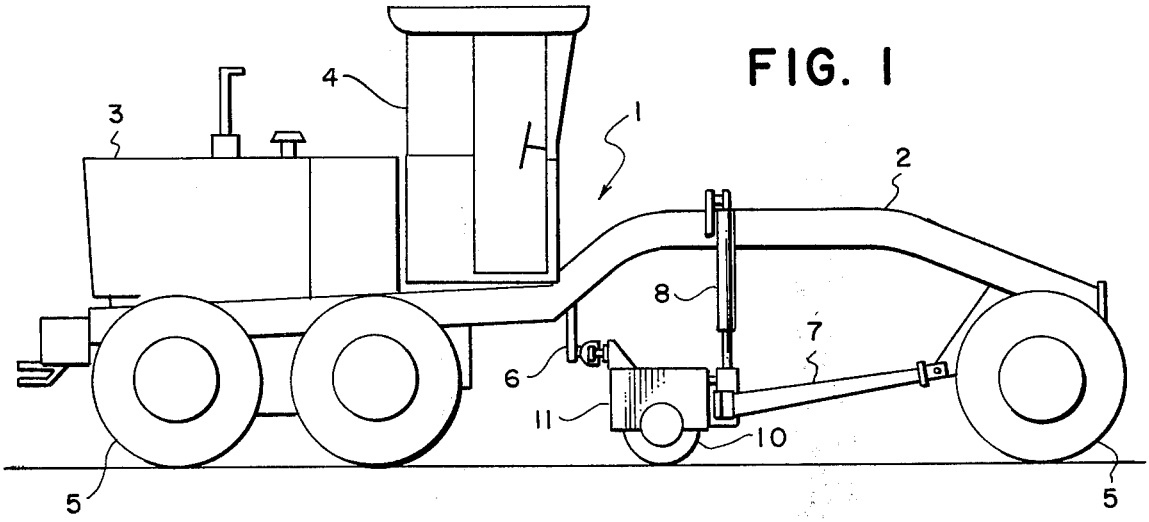
FIG. 1 is a side elevation of a typical road planing machine of the cold planer type.
Figure 2:
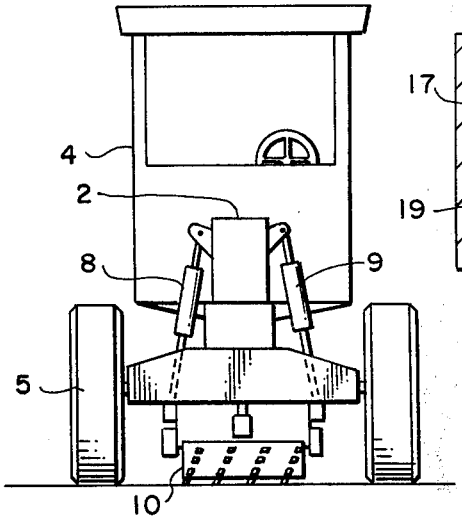
FIG. 2 is front elevation of the road planer of FIG. 1.

The road planer 1 of FIGS. 1 and 2, has a frame 2, its own power source such as internal combustion engine 3, an operator's compartment or cab 4, and mobile surface engaging means such as wheels 5. A rotary cutting head 10 is suspended from the planer frame 2 in such a manner that it can be adjusted vertically to control the depth of cut, or tilted from side to side to control the inclination of cut. Frequently the suspension system will also provide for transverse or lateral adjustment of the cutting head relative to the planer vehicle.

Various suspension systems can be employed to support the cutting head 10, and although it does not form part of the present invention, the suspension shown in FIG. 1 is briefly discussed for purposes of illustration. The cutting unit is pivotably supported in the back by a support arm and socket 6 depending from the frame 2. A tie rod 7 is pivotably connected to both the front of the cutting unit and the forward part of the planer frame. Adjustable support arms, such as hydraulic cylinders 8 and 9, are pivotably connected to the planer frame above the cutting head, and respectively to the opposite sides of the cutting head itself. By regulating the extension and retraction of the cylinders 8 and 9, the cutting head 10 can be raised, lowered, or canted to either side as desired.

Figure 3:
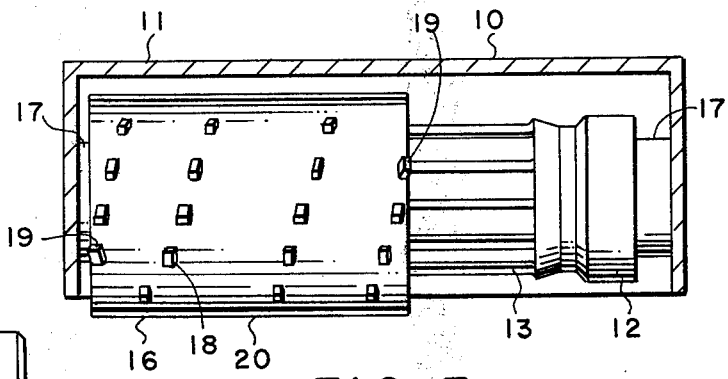
FIG. 3 is an elevational view of a rotary cutter and associated drive for a road planer which embodies the present invention.

Referring to FIG. 3, the cutting head 10 includes a housing 11, a rotary cutter 20, and drive 12 which are supported by bearings 17 at the ends of the housing 11. The drive may be of any suitable type, but is typically a hydraulic motor powered by a hydraulic pump mounted elsewhere on the planer and connected to the motor by hoses. A spacer 13 is connected at one end to the drive 12 and at the other end to the cutter 20. The spacer 13 can be substituted by one of different length or removed all together to accommodate cutters of different length in the housing 11.

The rotary cutter 20 includes a cylindrical drum 16 having a plurality of cutting units 18 mounted on it in a preselected pattern to cut a path as wide as the drum in the road surface. Certain of the cutting units along the ends of the drum and designated as 19 are deliberately canted outward to cut clearance for the end of the rotary cutter 20. The pattern of the cutters 18 may vary with the application, material to be cut, and other considerations, and is shown here as a helical arrangement for illustrtion only. For instance, in some cases it may be desirable to have a pattern in which two or more cutters are engaging the pavement at all times to balance or distribute the loading on the drum. In other cases, it may be desirable to have only one cutter engaging the pavement to concentrate the power transmitted at that point.

Figure 4:
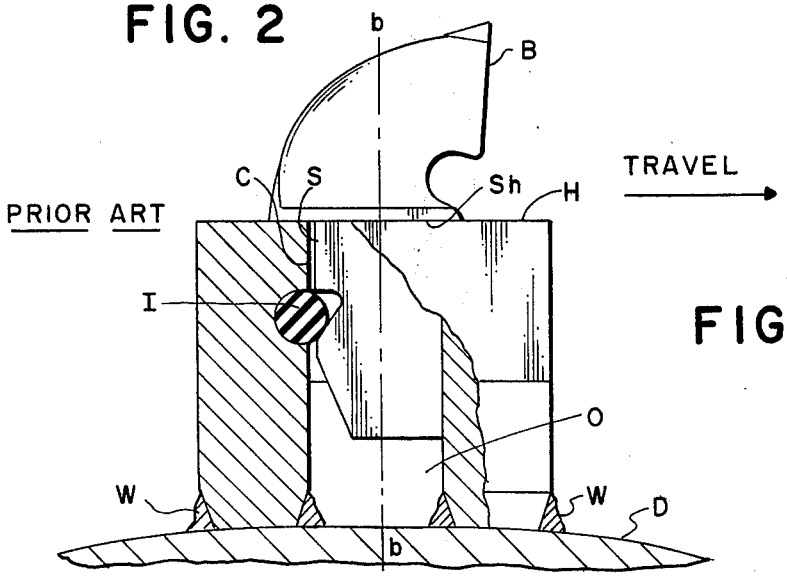
FIG. 4 shows a typical prior art arrangement of a cutter bit and bit holder used on a rotary cutting drum.

Before further describing the improved rotary cutter of the invention, a brief discussion of a typical prior art cutter used for road planers, as shown in FIG. 4, will aid in understanding and appreciating the invention. A rotatable drum is indicated at D. A plurality of bit holders H are welded to the drum D, and each has an opening O extending generally radially with respect to the drum. The cutter bits B each have a shank S which is sized to fit freely in the opening O, and a shoulder S*h* which seats against the holder H. Generally mating notches are provided in the wall of the opening O and the bit shank S. A removable insert I is placed in the mated notches to lock the bit in the holder.

Note that the axis *b*—*b* of the cutter bit B lies generally radial to drum D. Accordingly, the cutting action produces a maximum and significant bending moment where the legs of the bit holder are welded to the drum surface, which areas are indicated at W. The potentially high bending moment due to this arrangement requires a greater amount of weld W around the base of the holder.

Furthermore, as mentioned, the bit shank S is made to fit freely into the opening O, leaving a certain amount of clearance C between the bit shank and the holder. In operation, the bit is repeatedly impacting the paved surface, causing movement of the bit in its holder. The result is rapid wear of the opening O in the bit holders. Since the holders H are typically permanently attached to the drum, when a few of them become so worn that the openings become too loose to retain the bit effectively, the entire drum must be taken off and refurbished.

Figure 6:
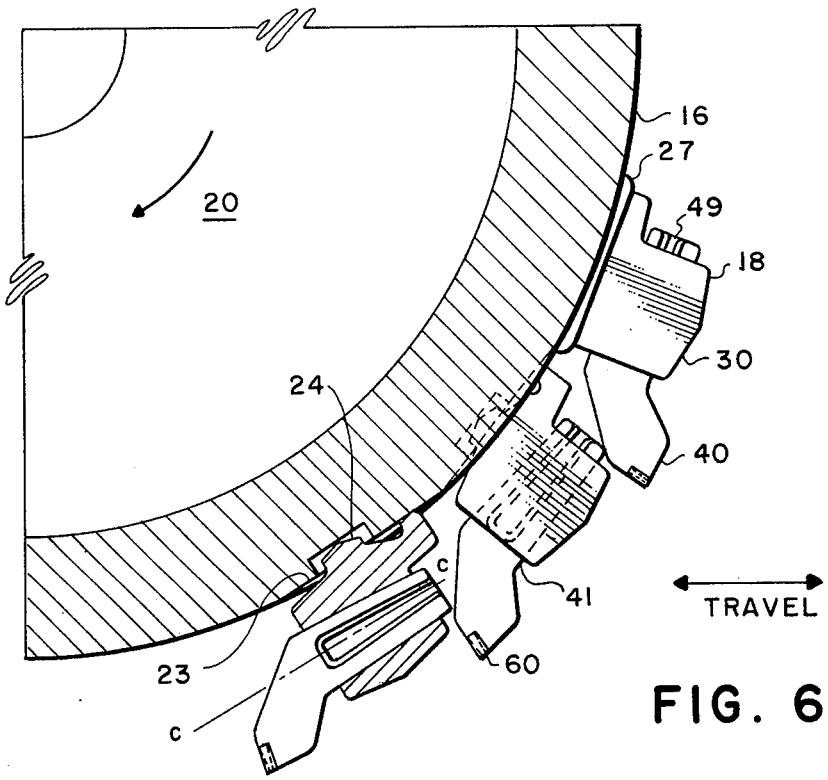
FIG. 6 is a sectional view of the cutter of FIG. 5 as taken along the line 6—6 of FIG. 5.
Figure 5:
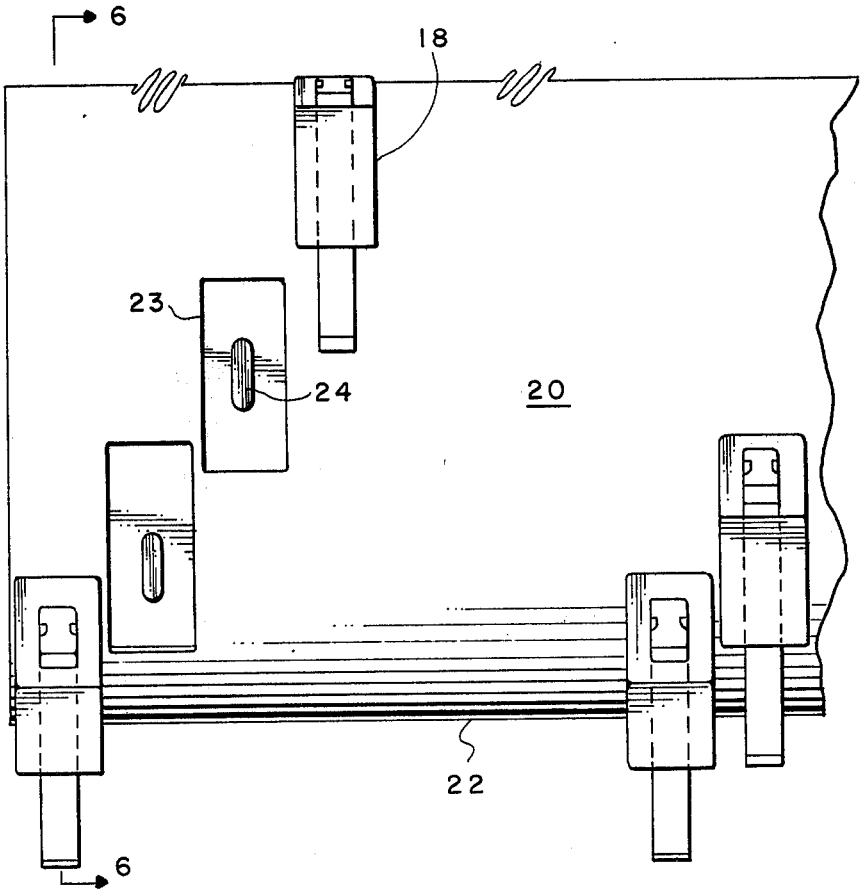
FIG. 5 is an enlarged elevational view of a portion of a rotary cutter as shown in FIG. 3.

Referring now to FIGS. 5 and 6, a portion of a rotary cutter 20 embodying the present invention is shown in greater detail. The cylindrical drum 16 is preferably made of steel and has a substantially thicker wall than that of the cutters used heretofore. The thicker wall gives the drum additional weight and greater inertia thus enhancing its cutter action. The high inertia cutting reduces the shock on the cutting bits and holders and thereby further extends their life. The wall thickness of the drum 16 will vary according to the application. However, by way of example, a drum having a nominal 20 inch diameter and a nominal wall thickness of 2 inches has shown effective performance.

A plurality of flats 23 are milled on the drum surface corresponding to the pre-selected pattern for the cutters 18. Slots or keyways 24 are provided generally in the center of the flats and serve to locate and orient the bit holders 30 as will be further explained below.

Figure 10:
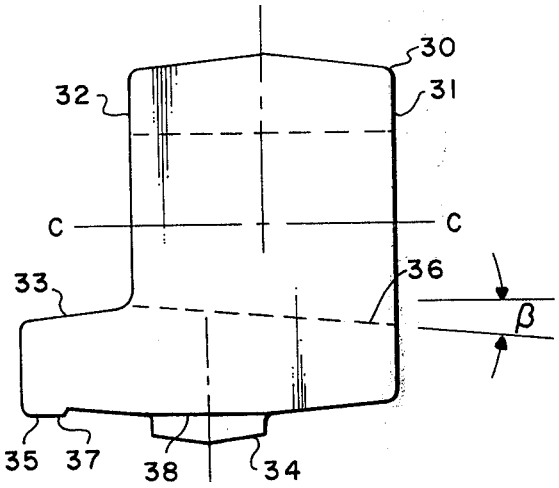
FIG. 10 is a side view in elevation of an improved bit holder suited for use in the rotary cutter of the present invention.
Figure 11:
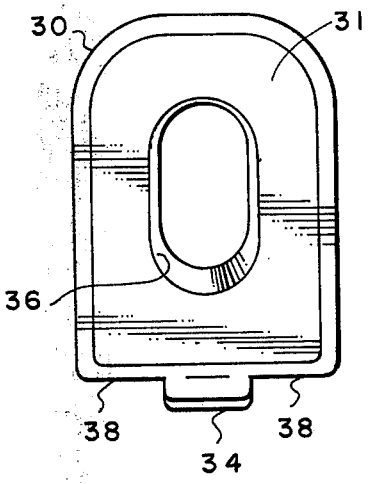
FIG. 11 is an end view in elevation taken from the right of the bit holder of FIG. 10.
Figure 12:
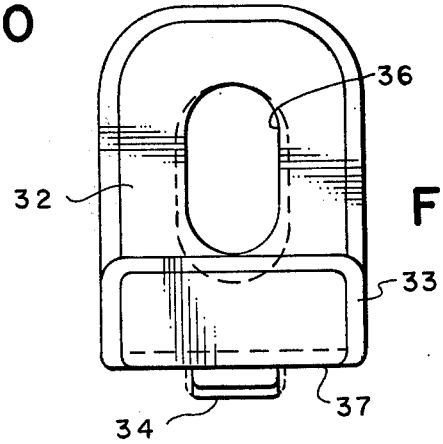
FIG. 12 is an end view in elevation taken from the left of the bit holder of FIG. 11.

The bit holder 30, shown in FIGS. 10–12, is a forging, preferably of alloy heat treated steel, and includes a main body having generally parallel front and rear faces 31 and 32. A flange 33 extends from the rear of the holder body and includes a downwardly depending tab 35. Extending down from the body portion is a lug 34, which is located behind the vertical centerline of the body.

The bottom of the holder body, which is otherwise a raw forging, has a coined flat surface 38 on both sides of the lug 34. A flat surface 37 is also coined on the bottom of the tab 35 and lies in the same plane as the flats 38.

As mentioned earlier, the design of the drum 16 and the bit holders is such as to allow quick and accurate attachment of the holders in the desired pattern on the drum surface. The lugs 34 on the bottom of the holder fit conveniently into the slots 24 on the drum. Although free fitting, the lugs are generally the same shape and size as the slots, and not only locate the holder in the pattern, but also align the socket 36 along the circumference of the drum.

The flats 37 and 38 on the bottom of the holder seat upon the flat 23 milled on the drum surface to automatically provide the proper elevation of the holder with respect to the drum surface. The holder 30 is conveniently secured in place by running a weld 27 around all or part of its perimeter, but it is foreseeable that other means of attaching the holders might be used. As mentioned earlier, certain of the cutter units 19 along the ends of the drum may be canted outward to cut clearance. For those units, the bottom of the holder 30 can be forged or machined to provide the desired angle of cant, or in the alternative, the corresponding flat 23 on the drum can be machined to the desired angle. The latter means is preferred since standard bit holders 30 can be used for replacement without further machining.

Referring again to FIGS. 10–12, an opening or socket 36 extends through the body of the holder 30 along axis C—C which is generally perpendicular to the faces 31, 32 and parallel to the flats 37, 38. The top of the socket is parallel to the axis C—C, but the other three sides are tapered as indicated. Specifically, it has been found advantageous to taper the bottom of the opening by an angle $\beta$ of a few degrees. The sides are tapered by an angle $\alpha$ which is smaller and may be only 1°. Although the socket 36 could conceivably be formed by other means, the drop forging process is found particularly convenient for simultaneously forming the converging tapers.

Figure 7:
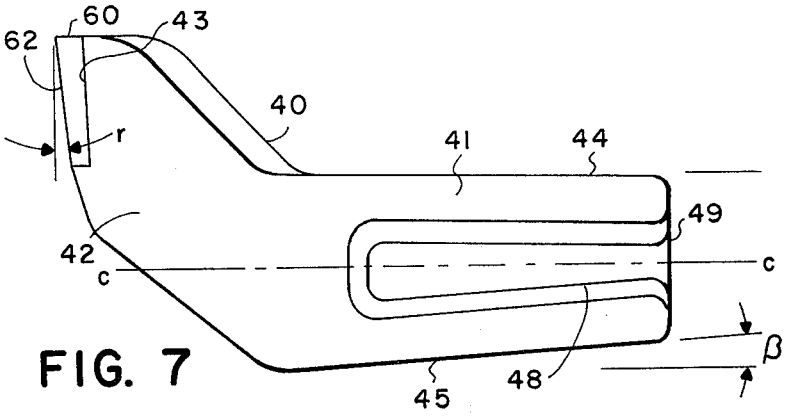
FIG. 7 is a side view of an improved cutter bit suited for use in the rotary cutter of the present invention.
Figure 9:
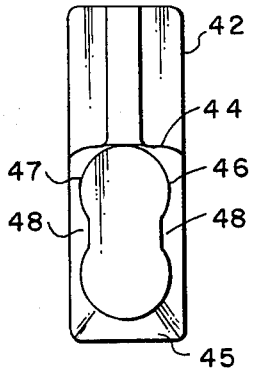
FIG. 9 is an end view in elevation from the right of the cutter bit of FIG. 7.
Figure 8:
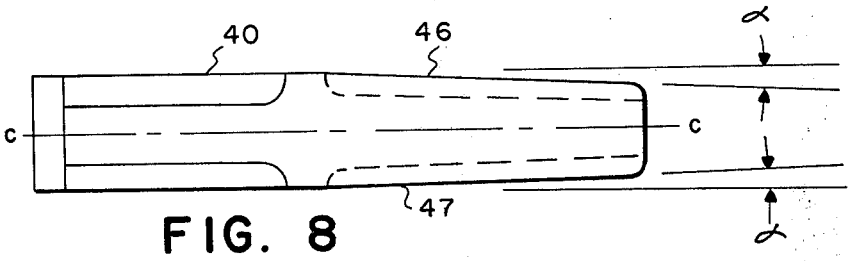
FIG. 8 is a plan view from the top of the cutter bit of FIG. 7.

The cutter bit 40, as shown in FIGS. 7–9, is also preferably a forging and includes a shank 41 and a body portion 42 joined by a shoulderless transition. An imaginary axis *c—c* of the shank 41 is defined parallel to the top surface 44. The bottom surface 45 and both surfaces 46 and 47 are tapered from the body to converge toward the rear of the shank as shown. As referred to herein, the top surface of the bit shank or holder socket means the surface which is radially outermost when the bit and holder are in the installed position on the drum 16. Similarly, the bottom surface 45 of the bit shank would be radially innermost, while the surfaces 46 and 47 would be the lateral sides.

It will be noted that the bit shank 41 and holder socket 36 are elongated in the vertical or radical direction. The top 44 and bottom of the shank are radiused as shown and match the corresponding surfaces of the socket 36. Because of the matching elongated cross-sections, it is impossible for the bits to twist in the holders. Reliefs 48 are formed in the sides 46, 47 of the shank to reduce binding when the bit is inserted in the holder.

The bottom 45 of the bit shank is tapered an angle $\beta$ and the lateral sides 46 and 47 are tapered by the smaller angle $\alpha$ such that the taper of the bit shank 41 matches that of the opening 36 in the bit holder. When installed the axis *c—c* of the bit corresponds with the axis *c—c* of the socket. Thus, when the bit 40 is inserted in a holder 30 which has been properly mounted on the drum, as discussed earlier, the axis of the bit is automatically aligned generally tangent to the surface of the drum 22.

The bit 40 also includes a hardened cutting tip in the form of an insert 60 which is embedded in the body portion 41. Hard materials for such cutting tips, such as tungsten carbide, and the means of fixing them in the cutter bit are well known and do not form part of the present invention. However, it is important to note that the surface 43 of the bit against which the insert 60 bears is generally perpendicular to the axis *c—c*. The cutting face 62 of the insert can, of course, be provided with a positive, negative, or zero degree rake angle *r* as the application demands.

Referring again to FIG. 5, the co-operative effect of the design features of the cutter bit 40 and bit holder 30 is discussed. As mentioned, when the bit 40 is placed in a mounted bit holder 30, the axis of the bit shank 41 conforms to the axis *c—c* of the socket and is generally tangential to the surface of the drum 22. Notwithstanding the rake angle *r*, the cutting face 62 of the bit will lie generally perpendicular to the bit axis *c—c*. Accordingly, when the drum is rotated in the direction shown by the arrow, the forces acting against the bit 40 as it engages the road surface will be along the axis *c—c* to enhance the tight fit of the bit shank 41 in the socket 36. Therefore, the bit is maintained tight at all times and does not cause wear on the socket 36.

As mentioned earlier, the cutter bit does not have a shoulder which seats against the holder. Rather, the bit shank 41 and socket 36 are so sized that the bit seats in the holder against its tapered shank 41. When fully seated a portion of the bit shank 41 still extends forward of the face 31 of the holder. Furthermore, as also noted earlier, the top or radially outermost surfaces of the bit shank and socket are parallel to axis *c—c* and tangent of the drum surface.

With this design, it is a further feature of the invention that the normal distance of the cutting tip 60 from the drum surface is always the same no matter how far the bit is forced into the holder. Thus, even though the shank of one bit be worn, manufactured over or under size, or driven more forcibly into the socket, the cutting tip will still have the same cutting depth as the other bits. Not only does this feature insure a uniform and constant depth of cut, but it reduces the need for closer tolerances in the manufacture of the bits 40 and holders 30. The described design of the bit 40 and holder 30 also has the effect to reduce the bending moment at the foot of the holder which results from the cutting action. First, by having the bit shank 41 disposed along a tangential axis it is possible to reduce the distance from the cutting tip to the drum surface as compared to the prior art as shown in FIG. 4. Secondly, the flange 33 extends back and contacts the drum through the tab 35, and thus accepts the reaction from the bending moment around the center of the holder. As a result, less weld is needed to mount the holders 30 with sufficient strength to resist the high cutting forces. Again, this results in a lower cost of manufacture.

Another feature of the disclosed design is more apparent. Since the bit shank 41 extends tangentially through the holder, and since it is not held in place by any insert, key, or the like, it can be easily removed by exerting a hammer blow to its distal end 49.

Having thus described the invention with regard to the embodiment shown, it is apparent that it offers several significant advantages over the rotary cutters previously conceived for road planers. First, it has improved cutting ability because of a higher inertia drum and because the cutting bits are maintained firmly in place at all times. Secondly, it can be manufactured more economically because no elaborate jigs are required to locate and align the several bit holders, because less weld is required to hold the holders on the drum, and because the bits and holders can be manufactured to practical forging tolerances. Yet, despite the costs savings in the manufacture, the cutting bits can be easily inserted and removed, and close control over the depth of cut from bit to bit is not sacrificed. Finally, since there is little or no movement of the bits in the sockets of the bit holders during the cutting operation, the life expectancy of the whole rotary cutter is significantly increased.

Finally, it should be noted that a rotary cutter embodying the present invention can be used to effectively perform either climb milling or up milling as dictated by the material to be cut or by the operator.

The embodiments of the invention in which an exclusive property or privilege is claimed are defined as follows:

1. An improved rotary cutter for a road planing machine suitable for cutting a path in hardened paving materials such as asphalt, concrete, or the like, comprising:

a cylindrical drum adapted to be suspended from a surface engaging vehicle on a generally horizontal axis of rotation;

a plurality of bit holders attached to the periphery of the drum, each of the holders having a tapered socket extending through the holder along an axis spaced from and generally tangential to the drum surface; and a plurality of cutter bits, each having a body portion including a cutting tip and shoulderless shank extending along an axis generally perpendicular to the cutting face of the cutting tip, wherein said bit shank is tapered along its axis corresponding to the taper in the socket of the bit holders and is sized such that when the bit is inserted in its respective bit holder it will seat snugly on its tapered shank in the socket of the holder, whereby the cutting forces imposed on said bits when the rotary cutter is cutting a paved surface act tangential to the drum surface and generally along the axis of the bit shank to hold it in snug engagement with the bit holder without the need for any positive locking means to hold the bit in place.

2. An improved rotary cutter as recited in claim 1, wherein the shank of the cutter bit is longer than the socket through the holder and extends beyond the holder such that the bit can be removed by applying a force to its free end.

3. An improved rotary cutter as recited in claim 1, wherein the shank of the cutter bit has three or more sides and conforms in cross section to the socket in the bit holder such that once inserted the cutter bit cannot turn relative to the bit holder.

4. An improved rotary cutter as recited in claim 3, wherein the shank of the cutter bit has generally four sides and at least three of them are tapered with respect to its axis.

5. An improved rotary cutter as recited in claim 4, wherein at least two sides of the bit shank are partially relieved to facilitate easier insertion into the bit holder.

6. A road planer as recited in claim 4, wherein at least one side of the socket is parallel to the tangent of the drum surface and the corresponding side of the bit shank is parallel to the axis of the bit shank such that the distance of the cutting tip of the bit is generally constant independent of how far the bit is forced into its holder.

7. An improved rotary cutter as recited in claim 1, wherein the socket in the bit holder has generally four sides, the radial outer side being parallel to the axis of the socket and tangent to the drum surface, and the radial inner side being tapered relative to the outer side such that the distance of the cutting tip from the drum surface remains generally constant, notwithstanding the extent to which the bit is forced into the socket.

8. An improved rotary cutter as recited in claim 7, wherein the lateral sides of the bit holder are also tapered to hold the bit shank firmly in the lateral direction.

9. An improved rotary cutter as recited in claim 1, wherein said cutter bits and bit holders are aranged on the drum in a pre-selected pattern effective to cut a continuous path as the cutter potates and advances along in the paved surface.

10. An improved rotary cutter as recited in claim 8, wherein certain of the bit holders along the ends of the drum are canted outwardly such that the bits inserted in those holders will cut clearance for the drum.

11. An improved rotary cutter as recited in claim 1, wherein said drum is a thick-walled heavy metal cylinder providing high inertial impact to the pavement through the cutter bits when it is rotated.

12. An improved rotary cutter as recited in claim 11, wherein the wall thickness of the drum is in the range of one-tenth the diameter of the drum or greater.

13. An improved rotary cutter for a road planer especially suited for cutting paved surfaces of asphalt, concrete, or the like, comprising:

a cylindrical drum adapted for suspension under a surface engaging vehicle on a generally horizontal axis of rotation, said drum having a plurality of flat areas arranged in a pre-selected pattern on its cylindrical surface;

a plurality of bit holders mounted on the drum in the respective flat areas, each of the holders having a main body with a tapered socket extending through the body along an axis generally tangential to the drum surface, each holder further having a flat surface for registration against the flat area on the drum to properly align the axis of the socket; and a plurality of cutter bits each having a cutting tip and a tapered shank adapted to be seated snugly in the socket of a bit holder such that the cutting tip will be spaced radially outward of the bit holder and the cutting action of the rotary cutter will force the respective cutter bits more tightly into the corresponding bit holders.

14. An improved rotary cutter as recited in claim 13, wherein the bit holders are welded to the drum surface.

15. An improved rotary cutter as recited in claim 13, wherein the drum has slots cut in the flat areas, and the bit holders have integral lugs extending from the main body and adapted to fit in the slots to facilitate location and alignment of the bit holders.

16. An improved rotary cutter as recited in claim 13, wherein the bit holders each have a rear flange extending from the main body of the holder in the direction opposite to that of the cutting tip of the bit, said flange having a heel in contact with the flat area of the drum such that the engagement between said flange and the drum is effective to accept the reaction of the bending moment about the center of the holder due to the cutting action of the cutter.

17. An improved rotary cutter for a road planer especially suited for cutting paved surfaces, comprising:

a cylindrical drum adapted for suspension from the road planer on a generally horizontal axis of rotation;

a plurality of bit holders arranged on the periphery of the drum according to a pre-selected pattern, each of the holders having a continuous socket extending through the holder along an axis spaced outwardly from and generally tangential with the drum surface; and a plurality of cutter bits, each having a body including a cutting tip and a shoulderless tapered shank extending from the body opposite the cutting tip, said shank being adapted to fit in and through the socket in a bit holder such that the tapered shank will seat against the holder aligned generally parallel to the tangent of the drum surface and be held therein without any positive locking means.

18. An improved rotary cutter as recited in claim 17, wherein the cutting tip of each cutter bit is spaced radially outward relative to the common axis of the bit shank and the socket in the corresponding holder, and has a cutting face lying on a plane extending generally radially from the drum.

19. An improved rotary cutter as recited in claim 18, wherein the shank of each cutter bit has at least three sides and generally corresponds in cross-section to the socket in one of the bit holders.

20. An improved rotary cutter as recited in claim 19, wherein at least one side of the socket in a bit holder and the corresponding side of the corresponding bit shank are parallel to a tangent to the drum surface such that the distance of the cutting tip from the drum surface remains constant once the bit is firmly inserted in the holder.

21. An improved rotary cutter as recited in claim 20, wherein the drum is a thick-walled steel cylinder.

22. An improved rotary cutter as recited in claim 21, wherein each of the bit holders is a metal forging.

23. An improved rotary cutter as recited in claim 22, wherein each of the cutter bits is a metal forging.

24. An improved rotary cutter as recited in claim 23, wherein the cutting tip of each cutter bit is an insert of hardened cutting material mounted in the body of the forging.

25. An improved rotary cutter as recited in claim 24, wherein the shank of each cutter bit has four sides, one of said sides being parallel to the axis of the socket in the respective bit holder, and the other three sides being tapered with respect to said one side.

* * * * *

UNITED STATES PATENT OFFICE

CERTIFICATE OF CORRECTION

Patent No. 4,006,936 Dated Feb. 8, 1977

Inventor(s) Wesley Irving Crabiel

It is certified that error appears in the above-identified patent and that said Letters Patent are hereby corrected as shown below:

Column 7, line 59, "potates" should read -- rotates --.

Signed and Sealed this

Twelfth Day of April 1977

[SEAL]

*Attest:*

RUTH C. MASON
*Attesting Officer*

C. MARSHALL DANN
*Commissioner of Patents and Trademarks*